US005327736A

United States Patent [19]

Hino

[11] Patent Number: 5,327,736

[45] Date of Patent: Jul. 12, 1994

[54] METHOD AND APPARATUS FOR STORING HEAT IN ICE BY USING REFRIGERANT JET

[75] Inventor: Toshiyuki Hino, Chohu, Japan

[73] Assignee: Kajima Corporation, Tokyo, Japan

[21] Appl. No.: 56,870

[22] Filed: May 5, 1993

Related U.S. Application Data

[60] Division of Ser. No. 974,389, Oct. 23, 1993, Pat. No. 5,218,828, which is a continuation of Ser. No. 737,139, Jul. 29, 1991, abandoned.

[30] Foreign Application Priority Data

Dec. 28, 1990 [JP] Japan ..... 2-409168

[51] Int. Cl.[5] ..... F25D 3/00

[52] U.S. Cl. ..... 62/330; 62/123; 62/340

[58] Field of Search ..... 62/59, 74, 123, 330, 62/533, 534, 541, 340

[56] References Cited

U.S. PATENT DOCUMENTS

| | | | |
|---|---|---|---|
| 3,247,678 | 4/1966 | Mohlman | 62/534 X |
| 3,456,452 | 7/1969 | Hilbert | 62/59 |
| 4,254,635 | 3/1981 | Simon et al. | 62/59 X |
| 4,596,120 | 6/1986 | Knodel et al. | 62/59 |
| 4,838,039 | 6/1989 | Knodel | 62/330 |
| 5,065,598 | 11/1991 | Knodel et al. | 62/59 X |

*Primary Examiner*—William E. Tapolcai

*Attorney, Agent, or Firm*—Oblon, Spivak, McClelland, Maier & Neustadt

[57] ABSTRACT

The method stores heat in ice by freezing water through its direct contact with a hardly-water-soluble refrigerant; i.e., water is mixed with the refrigerant at a high pressure to produce a liquid mixture while preventing evaporation of the refrigerant, and the liquid mixture is jetted from a nozzle into a space at a lower pressure, whereby the refrigerant evaporates at the lower pressure and the water in the liquid mixture is frozen into sherbet-like ice and dispersed over a wider area than in the case of non-sherbert-like ice. A device based on the method uses a heat-insulating water tank whose top space above water level therein is kept at a pressure P2 lower than saturation pressure P0 (P2<P0) of the refrigerant for water freezing point 0°C. A mixer mixes the refrigerant of liquid phase and water at a pressure P1 which is higher than the saturation pressure P0 of the refrigerant for water freezing point 0°C. (P0<P1), so as to produce a liquid mixture without allowing evaporation of the refrigerant. A nozzle having an opening in the top space of the water tank jets the thus prepared liquid mixture to the top space at the pressure P2, whereby the refrigerant evaporates so as to freeze the water of the liquid mixture into sherbet-like ice.

6 Claims, 11 Drawing Sheets

METHOD AND APPARATUS FOR STORING HEAT IN ICE BY USING REFRIGERANT JET

This is a division, of application Ser. No. 07/974,389, filed on Oct. 23, 1993, now U.S. Pat. No. 5,218,828, which is a continuation of application Ser. No. 07/737,139, filed on Jul. 29, 1991, now abandoned.

BACKGROUND OF THE INVENTION

1. Field of the Invention

This invention relates to a method of storing heat in ice by using refrigerant jet and an apparatus therefor. In particular, the invention relates to a method and device for storing heat in ice by using refrigerant jet, in which liquid phase refrigerant is jetted together with water, and after being jetted the refrigerant evaporates and water comes in contact with the evaporating refrigerant so as to freeze.

2. Description of the Prior Art

From the standpoint of reducing the size of heat storing apparatus, attention has been paid to direct-contact-type heat exchange in which water is brought to direct contact with liquid-phase refrigerant having a low water solubility (including water-insoluble refrigerant, to be referred to as "hardly-water-soluble refrigerant), so as to cool the water with the latent heat of evaporation of evaporating hardly-water-soluble refrigerant until the water freezes. The following three kinds of structures have been proposed to practice such direct-contact-type heat exchange.

A blowing type as shown in FIG. 8: Liquid-phase refrigerant is blown into cooling water 2*b* in a water tank 1, so as to produce sherbet-like ice 2*a*.

An individual nozzle type as shown in FIG. 9: Liquid-phase refrigerant from a liquid refrigerant pipe and cooling water from a cooling water return pipe 18 are simultaneously blown into a water tank 1 through refrigerant nozzles 4 and water nozzles 5, respectively, so as to produce water-ice mixture 2.

A chamber type as shown in FIG. 10: Water and refrigerant are mixed in a chamber 25 which is provided in the space above water surface of a water tank 1, and ice slurry produced by the mixing slides down onto the water in the tank 1 through lower opening of the chamber, while evaporated refrigerant gas moves upward to a refrigerant gas outlet pipe 6 through an upper opening of the chamber.

Operation of the blowing type in FIG. 8 will be briefly described in the case of cooling operation. Refrigerant gas, which has evaporated by chilling the cooling water in the water tank 1 after being jetted thereto from a liquid refrigerant pipe 12, moves upward to a refrigerant gas outlet pipe 6 leading to a compressor 7, and after being compressed it is fed to a compressed refrigerant gas pipe 8 leading to a refrigerant condenser 9. After liquefied, the refrigerant returns to the refrigerant liquid pipe 12 through an expansion unit 11, and completes one heat cycle of the refrigerant. The refrigerant condenser 9 is cooled by the outside air. Water-cooled refrigerant condenser 9 can be also used. The cooling water 2*b* in the water tank 1, which holds stored heat from the jetted refrigerant, is sucked to a cooling water outlet pipe 14 through the lower portion of the tank 1 by a cooling water circulating pump 15.

The cooling water from the circulating pump 15 enters into a cooling water heat-exchanger 16, and gives its heat to load-side piping 17, and then it returns to the water tank 1 through a cooling water return pipe 18, and completes one cycle of cooling water. To separate water and water drop from refrigerant, an eliminator 13 may be provided at the junction between the water tank 1 and the refrigerant gas outlet pipe 6, as shown in FIG. 9.

In the example of FIG. 8, the load-side piping 17 is connected to an air blower 21 which sends cooled air to an air conditioning apparatus 22, so as to accomplish the desired cooling function. A cooling unit 20, which is provided on the cooling water return pipe 18, has refrigerant passages connected to a branch refrigerant pipe extending from a cross valve 19 on the liquid refrigerant pipe 12 to another cross valve 19 on the refrigerant gas outlet pipe 6. Numeral 9*a* in the drawing shows a liquid receptacle unit for receiving liquid refrigerant dripped from the condenser 9.

In the case of heating operation, the condenser 9 is switched by a suitable switching means (not shown) so as to cause the refrigerant to absorb heat, and the refrigerant gives its absorbed heat to water in the water tank 1 so as to make it warm water.

The operations of the systems of FIGS. 9 and 10, are apparent to those skilled in the art from the foregoing description with respect to the example of FIG. 8.

SUMMARY OF THE INVENTION

The blowing type of FIG. 8 has a shortcoming in that, when the amount of ice in the cooling water of the water tank 1 increases in excess of a certain limit, the ice piles up on the water surface and tends to intervene with the mixing of the refrigerant with water, causing disturbance in ice formation thereafter. Such disturbance leads to reduction of overall efficiency of heat exchange and ice production.

To solve the above shortcoming, it has been proposed to add a fluidization agent in the cooling water to facilitate production of soft sherbet-like ice 2*a*. Examples of such fluidization agent include ethylene glycol, propylene glycol and the like. These fluidization agents exhibit properties as antifreezing fluids and they reduce the freezing point of cooling water to below 0° C. Thus, the use of fluidization agents tends to cause a problem in that the refrigerant evaporating temperature is lowered and the coefficient of performance (COP) of freezing cycle is reduced. Further, the use such agents also results in a cost increase and, in addition, possible environmental problem at the time of removing the cooling water from the water tank 1, e.g., for maintenance and repair of various apparatuses in the system.

The individual nozzle type of FIG. 9 is free from the above problem due to ice floating on water surface, because the refrigerant and water come in contact with each other substantially above the water surface and heat exchange takes place in air. It has, however, a different problem. Namely, gas-phase refrigerant, which is called flash gas, is generated at the gas trap (numeral 9*a* in FIG. 1) or the like, and the refrigerant flow through each refrigerant nozzle 4 tends to have two, gas and liquid, phases. With an ordinary nozzle, the presence of gas in the refrigerant flow therethrough reduces the centrifugal force at the outlet thereof, so that the spreading area of the refrigerant from the nozzle outlet tends to shrink. As the spreading area shrinks, the contact surface area between water and refrigerant becomes smaller, resulting in a reduction of heat exchange therebetween, which reduction leads to drop in both evaporating pressure and evaporating temperature of the refrigerant. Hence, the heat exchange efficiency is reduced and efficient ice formation is hampered. Besides, when the spreading radius of Ice is small if the amount of ice increases, an ice pile is inevitably formed immediately below the refrigerant nozzles 4, and such ice pile tends to disturb contact between ice and water. Once the ice pile is formed, deterioration of the contact heat exchange between refrigerant and water is accelerated, and the performance of ice formation rapidly erodes. The inventors confirmed such phenomena through experiments.

The chamber type of FIG. 10 appears to aim at prevention of the above-mentioned deterioration of the heat exchange performance by using the chamber 25, instead of the nozzles 4 and 5, for mixing the refrigerant and water. However, since ice produced in the chamber 25 falls down substantially vertically together with water through a lower opening thereof, ice pile is inevitably formed on water surface in the water tank 1 immediately below the lower opening of the chamber 25 when the amount of ice from the chamber 25 increases. Thus, suitable fluidization agent must be added to prevent formation of ice pile and to facilitate breakdown of ice pile when formed.

The chamber 25 is complicated in construction, and it is costly to make. Besides, from practical standpoint, it is difficult to design such chamber 25 so as to ensure continuous presence of water within it for mixing with liquid refrigerant while preventing both overflow and fall down through its upper opening and lower opening, respectively. Further, it is also difficult to operate such chamber 25 in line with the intention of its designer. The reason for such difficulty is in that flow rates of the liquid refrigerant and water vary depending on the running conditions or the overall thermal system of which the heat storing device is a part.

Therefore, an object of the present invention is to dissolve the above-mentioned shortcomings of the prior art by providing a method and an apparatus for storing heat in ice by using refrigerant jet, said refrigerant jet consisting of a mixture of liquid refrigerant and water and being jetted after the mixture is formed.

The inventors noted the fact that if a hardly-water-soluble refrigerant having boiling point lower than freezing point of water is merely mixed with water under normal pressure at a temperature below the water freezing point, the water thus mixed will freeze immediately after the mixing, but if pressure of the hardly-water-soluble refrigerant at the time of mixing is suitably selected, the freezing of water at the time of mixing can be avoided and the water thus mixed is allowed to freeze after jetting of the mixture through a nozzle to a pressure suitable for the freezing.

More specifically, at a location upstream of the nozzle, if the hardly-water-soluble refrigerant and water are mixed at a pressure higher than saturation pressure of the refrigerant for a temperature equivalent to water freezing point, and if the thus mixed mixture passes through a nozzle and is jetted toward downstream of the nozzle at a pressure lower than the saturation pressure of the refrigerant for the water freezing point, then the refrigerant stays in liquid phase without evaporation at the time of mixing and its evaporation immediately after the mixing is prevented, and yet the refrigerant in the mixture evaporates toward a wide area after being jetted through the nozzle so as to cause the water in the mixture to freeze after being jetted and the frozen ice to be dispersed over a wide area.

Referring to FIG. 1 through FIG. 3, in an embodiment of the method of storing heat in ice by using refrigerant jet according to the invention, the pressure of space 3 above water surface in a heat-insulating water tank 1 is set at P2 that is lower than saturation pressure P0 of a hardly-water-soluble refrigerant for a temperature equivalent to water freezing point ($P2<P0$). The refrigerant of liquid phase is mixed with water at a pressure P1 higher than the saturation pressure P0 ($P0<P1$). The thus mixed liquid mixture is jetted into the space 3 above water surface of the water tank 1 through a nozzle 32 that is disposed in the space 3. Whereby, the refrigerant of the thus jetted liquid mixture is caused to evaporate at its saturation temperature for the pressure P2 in the space 3 while deriving latent heat of evaporation from the water of the jetted liquid mixture, so that the water of the jetted liquid mixture freezes into sherbet-like ice 2*a* for storing heat in the thus frozen ice 2*a*.

An embodiment of the apparatus for storing heat in ice according to the invention is to freeze water with latent heat of evaporation of a hardly-water-soluble refrigerant, and the apparatus uses a heat-insulating water tank 1 whose inside pressure P2, such as the pressure in top space 3 thereof, is kept lower than saturation pressure P0 of a hardly-water-soluble refrigerant for a temperature equivalent to water freezing point ($P2<P0$). A mixer 30 mixes the refrigerant of liquid phase with water at a pressure P1 which is higher than the above-referred saturation pressure P0 ($P0<P1$). Output from the mixer 30 is connected to the inlet end of a nozzle 32, and outlet orifice of the nozzle 32 opens in the top space 3 of the water tank 1.

BRIEF DESCRIPTION OF THE DRAWINGS

For a better understanding of the invention, reference is made to the accompanying drawing, in which.

Like parts are designated by like numerals and symbols throughout different views of the drawing.

DETAILED DESCRIPTION OF PREFERRED EMBODIMENTS

Before entering details of preferred embodiments, the operating principles of the invention will be described.

Figure 4:
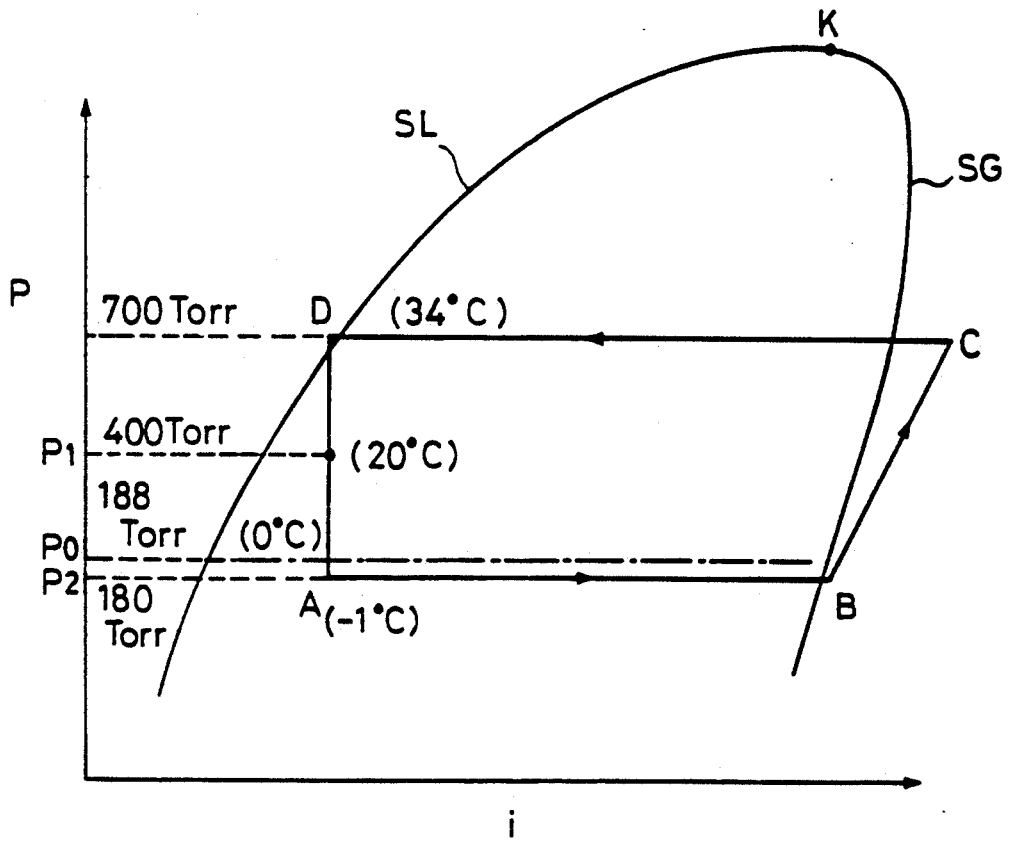
FIG. 4 is a graph showing a refrigerant heat cycle in an embodiment of the invention, in which the refrigerant is normal pentane.

Referring to FIG. 4 showing a heat cycle of hardly-water-soluble refrigerant to be used in the invention, the abscissa shows enthalpy i and the ordinate shows pressure P. The refrigerant is in liquid phase on and to the left of a saturation liquid line SL, and the refrigerant is in overheated gas phase to the right of a saturation gas line SG, and the refrigerant is in moist gas phase between the saturation liquid line SL and the saturation gas line SG. In the moist gas phase, when heated the refrigerant evaporates while absorbing latent heat of evaporation.

To show the heat cycle in numerical terms, normal pentane will be used in the following description as an example of the hardly-water-soluble refrigerant. The refrigerant to be used in the invention, however, is not restricted to normal pentane, and in fact, it is possible to use isobutane, neopentane, and other suitable refrigerants. As shown in FIG. 4, saturation pressure of normal pentane for a temperature equivalent to water freezing point 0° C. is approximately 188 Torr. With increase of pressure, the saturation temperature of normal pentane increases; for example, at a pressure of 400 Torr, the normal pentane has a saturation temperature of 20° C.

More specifically, if the pressure is kept at 400 Torr, liquid normal pentane will not boil at 0° C., and it boils only when the temperature is at 20° C. or higher. It means that, when liquid normal pentane is mixed with water under the pressure of 400 Torr, boiling temperature of the liquid normal pentane is not below 20° C. because its saturation temperature for this pressure 400 Torr is 20° C. The gas-liquid ratio of normal pentane may vary depending on evaporation and condensation, but liquid normal pentane will never boil at temperatures below 20° C. as long as the pressure is at 400 Torr. Thus, mere mixing of liquid normal pentane with water under the pressure of 400 Torr will not cause the thus mixed mixture to be cooled to 0° C. or below, and the water will not freeze by the mixing alone.

One may conclude that at a pressure higher than 188 Torr, which is the saturation pressure of the normal pentane for water freezing point 0° C., for example, at 400 Torr, even if water and liquid normal pentane are mixed by the mixer 30, the water in the thus mixed mixture will not freeze and a liquid mixture of water and normal pentane is produced. When such liquid mixture is fed to nozzle 32 having an orifice to a lower pressure space, it is possible to disperse the fluid mixture over a wide range by blowing it to the lower pressure space from the orifice of the nozzle 32.

FIG. 4 also shows that, at a pressure lower than 188 Torr that is the saturation pressure of the normal pentane for water freezing point of 0° C., for example, at 180 Torr, the saturation temperature of the normal pentane is −1° C. If the pressure in the water tank 1 is kept at, for example, this pressure 188 Torr, liquid normal pentane in the above fluid mixture dispersed form the nozzle 32 in the top space 3 of the water tank 1 starts to boil at −1° C. This boiling can be compared with the well-known fact that, if water with a pressure higher than 1 atm and having a temperature of 100° C. or higher is decompressed to 1 atm, the water starts to boil at 100° C., and if the water is continuously heated so as to be kept at 100° C. or higher, then the water continues to boil until the entire water is converted into vapor.

Figure 1:
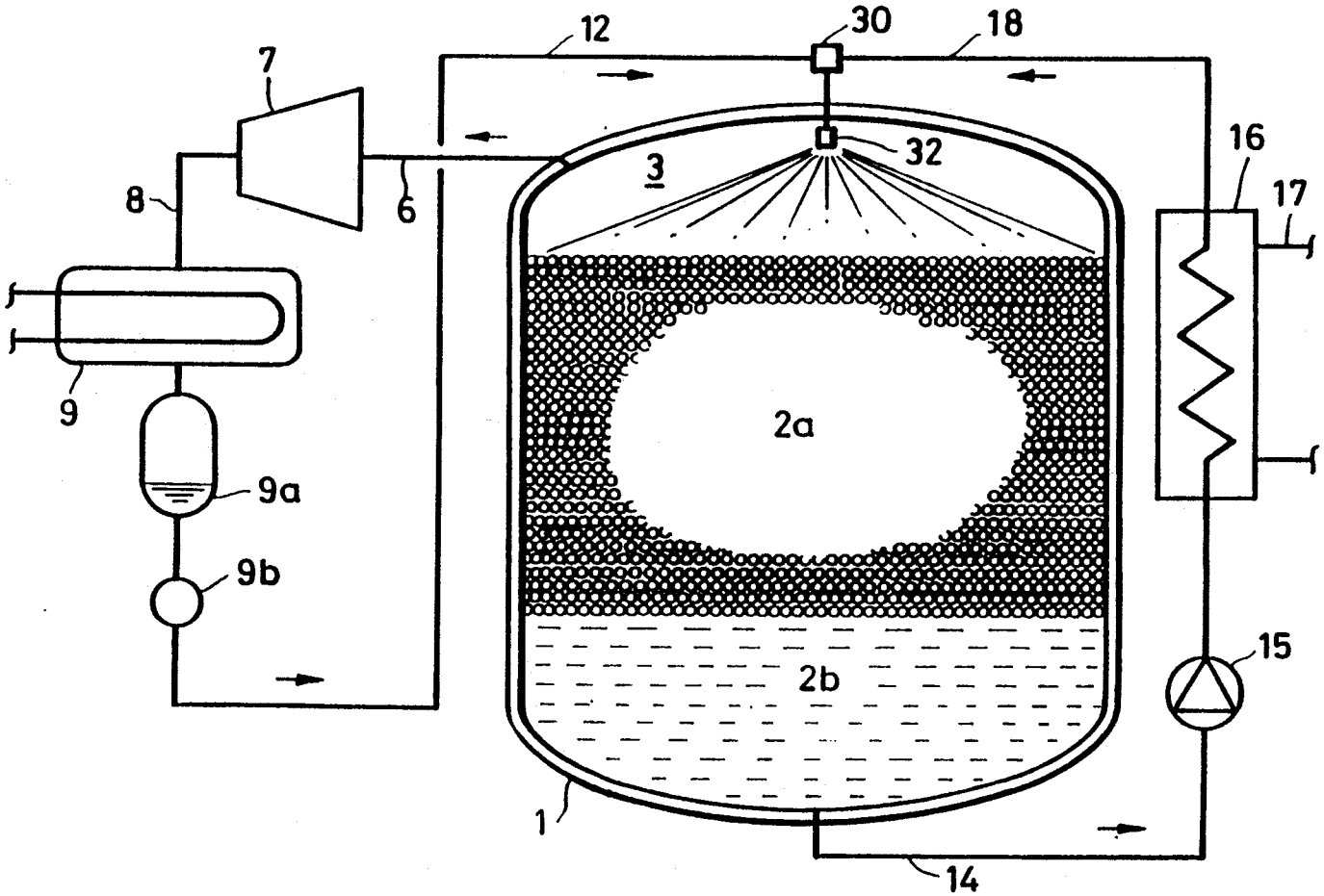
FIG. 1 is a schematic block diagram showing an embodiment of the device according to the invention.

In the embodiment of FIG. 1, when the refrigerant normal pentane jetted from the nozzle 32 boils at −1° C., the water jetted together with the refrigerant gives the latent heat of evaporation to the refrigerant and freezes into ice. In actual operation, the boiling temperature of the refrigerant often varies in a range from about 0° C. to −5° C. depending on the manner in which the refrigerant comes in contact with water. For simplicity, however, it is assumed to be −1° C. in the foregoing description.

Figure 3:
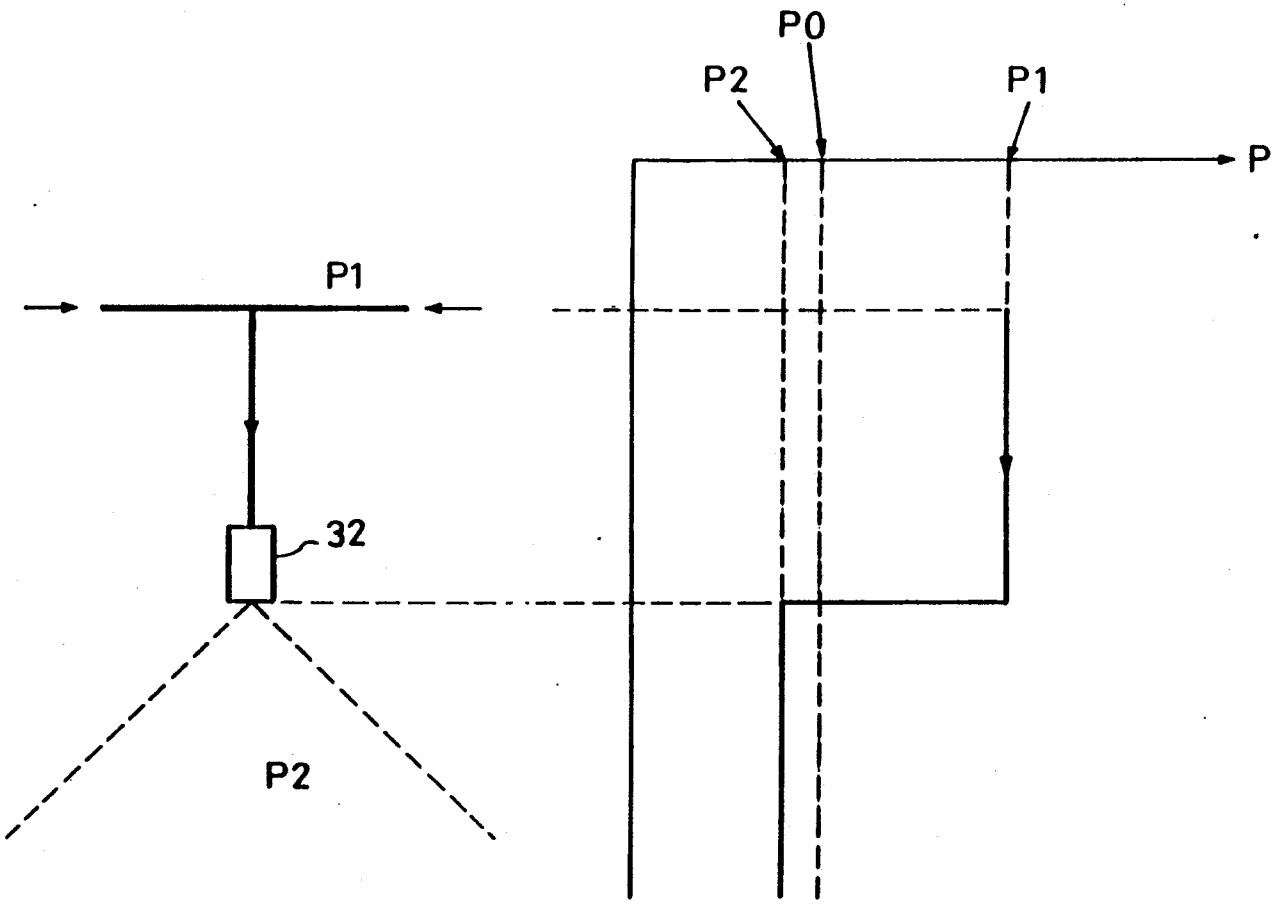
FIG. 3 is a simplified graph showing the pressure drop in a nozzle to be used in the apparatus of the invention.

FIG. 3 shows pressure in the nozzle 32. A pressure drop is produced across the nozzle 32, i.e., from the pressure P1 at inlet side piping thereof to the pressure P2 at outlet orifice which opens to the top space 3 of the water tank 1.

Once the refrigerant starts to boil, water jetted from the nozzle 32 is derived of the latent heat of evaporation by the refrigerant and the water itself freezes into ice. With the invention, the refrigerant is dispersed by the nozzle 32 over a wide range, and the ice thus produced is also scattered to a wide area, so that no ice piles are formed immediately below the nozzle 32.

In the embodiment in FIG. 1, the refrigerant extracted from a water tank 1 through a refrigerant gas outlet pipe 6 is compressed by the compressor 7 up to, for example, 700 Torr as shown in FIG. 4. The compressed refrigerant, which is at a high temperature such as 34° C., is fed to a condenser 9 through a compressed refrigerant gas pipe 8 so as to be cooled and liquefied. The liquid refrigerant from the condenser 9 is delivered to a liquid refrigerant pipe 12 through a liquid receptacle unit **9*a* and a gas trap 9*b*, and the liquid refrigerant thus delivered has a temperature of about 20° C. and a pressure of about 400 Torr. On the other hand, cooling water 2*b* in the water tank 1 is fed to a cooling water heat exchanger 16 by a cooling water outlet pipe 14 and a cooling water circulating pump 15. At the heat exchanger 16, heat is transferred from the cooling water 2*b* to, for example, loadside piping 17. The cooling water then flows into a return pipe 18**, where the pressure of the cooling water is at about 400 Torr.

The mixer 30 mixes the liquid refrigerant from the liquid refrigerant pipe 12 with the cooling water **2*b* from the cooling water return pipe 18 at a pressure of about 400 Torr, and it feeds the thus mixed liquid mixture to the nozzle 32 which is disposed in the top space 3 of the water tank 1. When normal pentane is used as the regrigerant, its saturation temperature for the pressure 400 Torr is high, and the water in the liquid mixture does not freeze before entering and being dispersed by the nozzle 32. If the pressure at the top space 3 is at 180 Torr, the refrigerant jetted from the nozzle 32 boils at the saturation temperature of −1° C. for the pressure 188 Torr, and waterdrops in contact with such boiling refrigerant is deprived of the latent heat of evaporation of the refrigerant and freezes into sherbet-like ice 2*a*. Thus, heat is stored in the sherbet-like ice 2*a*, which falls onto the cooling water 2*b*** and cools it.

Figure 2:
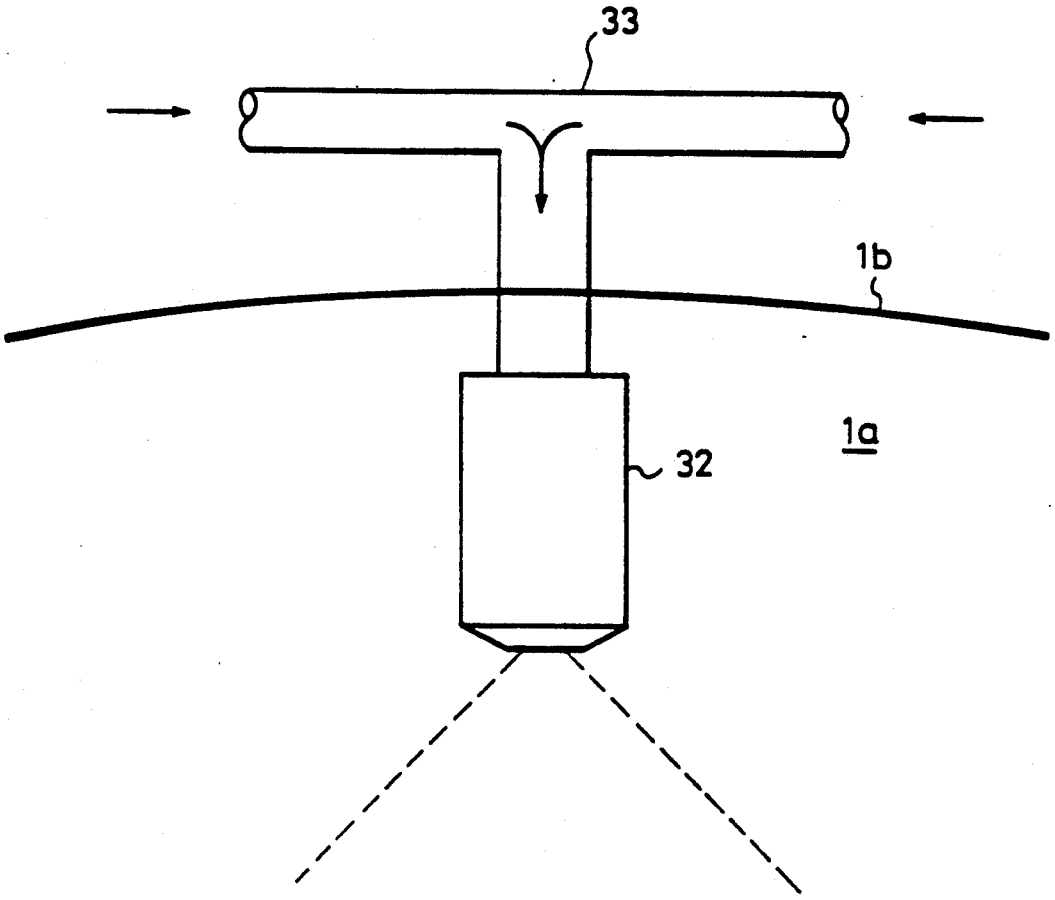
FIG. 2 is a schematic illustration of a T-shape mixer to be used in the device of the invention.

FIG. 2 shows a T-shape mixer 33 as a modification of the mixer 30 of FIG. 1. The T-shape mixer 33 has a horizontal straight tubular portion and a central leg portion depending from an intermediate section of the horizontal portion. The horizontal portion receives the refrigerant of liquid phase at one end and also receives water at the opposite end thereof, so as to mix the refrigerant and water therein. The central leg portion communicates with the horizontal portion at its intermediate section, so as to extract the thus mixed liquid mixture therefrom while further mixing the refrigerant and water therein. The illustrated T-shape nozzle 33 is connected to a single-orifice nozzle 32, but it is also possible to connect such T-shape mixer 33 to a multi-orifice nozzle of FIG. 5 for expanding the area of dispersing the sherbet-like ice *2a*.

Figure 5:
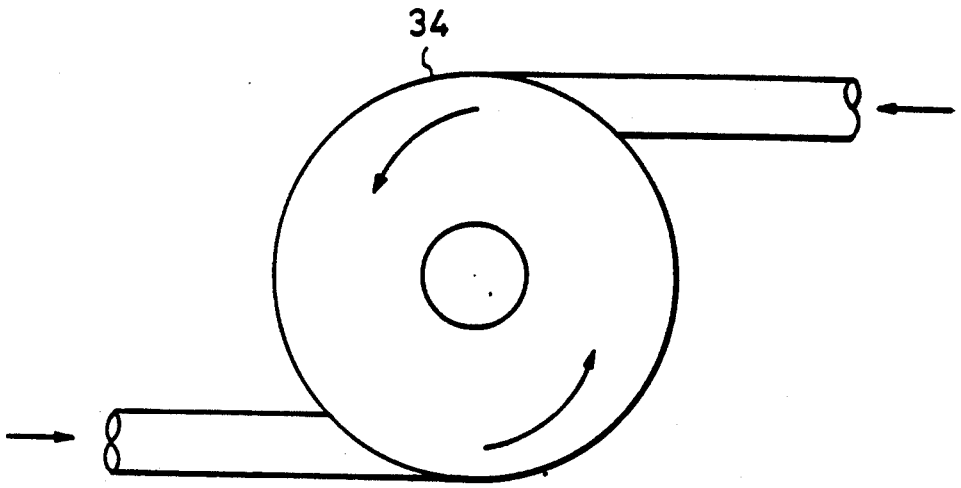
FIG. 5 is a schematic illustration of a circulation-type mixer to be used in the apparatus of the invention.
Figure 5:
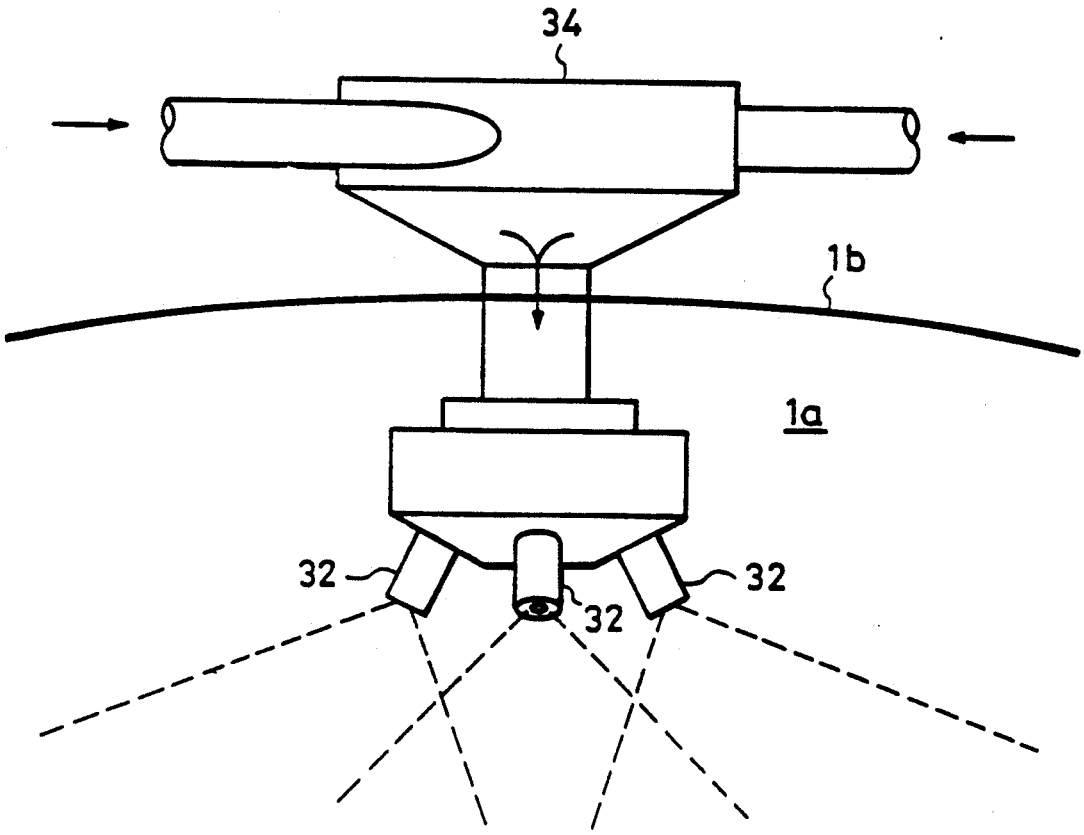

FIG. 5 shows a circulation-type mixer 34 as another modification of the mixer 30 of FIG. 1. The circulation-type mixer has a circular portion and a central leg portion depending from a central section of the circular portion. The circular portion receives the liquid refrigerant at one peripheral part thereof in a tangential direction thereat, and the circular portion also receives water at a diametrically opposite peripheral part thereof to the above one peripheral part in a tangential direction thereat. The thus received refrigerant and water circulate in the circular portion and get mixed with each other while circulating. The central leg portion communicates with the circular portion at its central section, so as to extract the thus mixed liquid mixture therefrom. The circulation-type mixer 34 ensures thorough mixing of the liquid refrigerant and water without using any power from the outside. The example of FIG. 5 expands the area of dispersion of sherbet-like ice *2b* by connecting the mixer 34 to a multi-orifice combination of nozzles 32. It is also possible to connect the circulation-type mixer 34 to a single-orifice nozzle.

Figure 6:
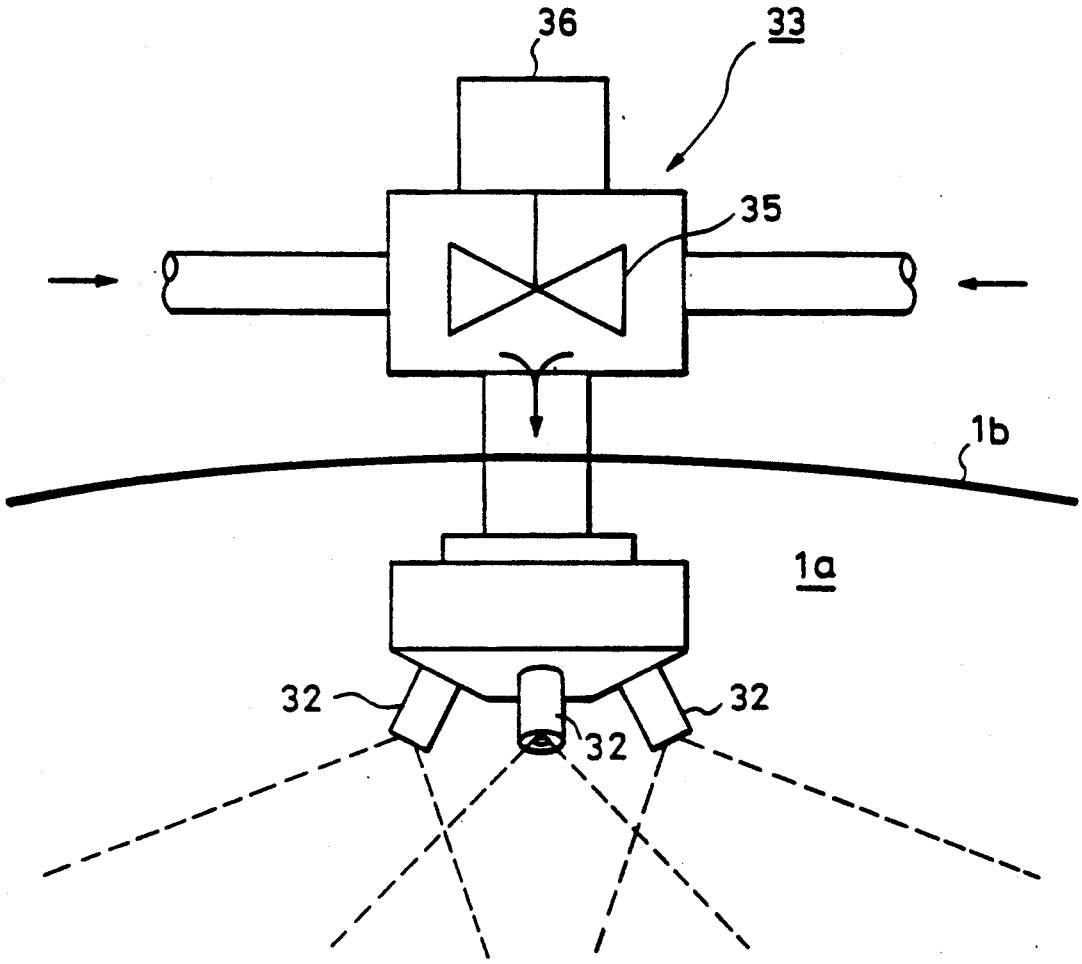
FIG. 6 is a schematic illustration of a motor-driven impeller disposed in a T-shape mixer to be used in the apparatus of the invention.

FIG. 6 shows a modification of the T-shape mixer 33, in which a motor-driven impeller 35 and its driving motor 36 are disposed in the intermediate section of the horizontal portion of the mixer 33. In the example, the impeller 35 is in the intermediate section and the motor 36 is attached to the outside of the intermediate section. The use of the impeller improves the degree of mixing of the liquid refrigerant with water. Although the illustrated mixer 33 with the impeller 35 is connected to a multi-orifice nozzle, it can be also connected to a single-orifice nozzle.

Figure 7:
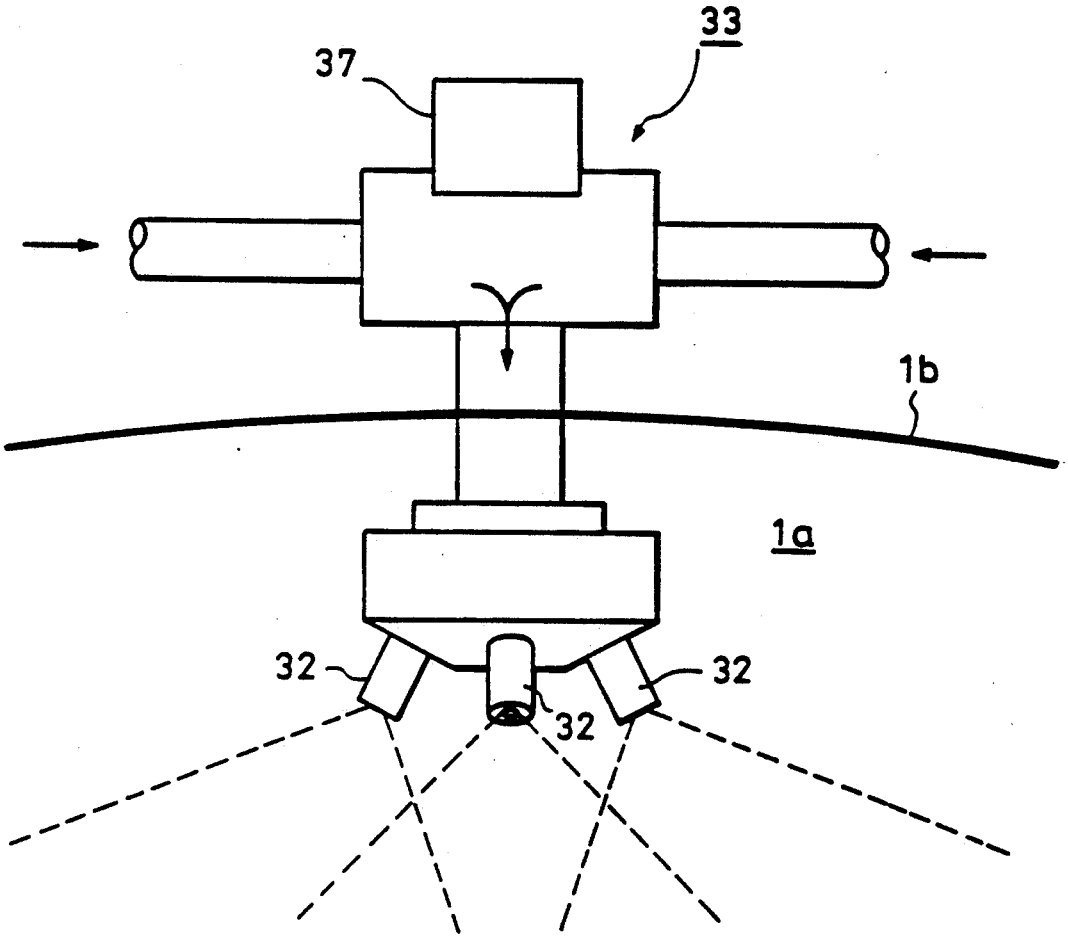
FIG. 7 is a schematic illustration of a sonar vibrator mounted on a T-shape mixer to be used in the apparatus of the invention.
Figure 8A:
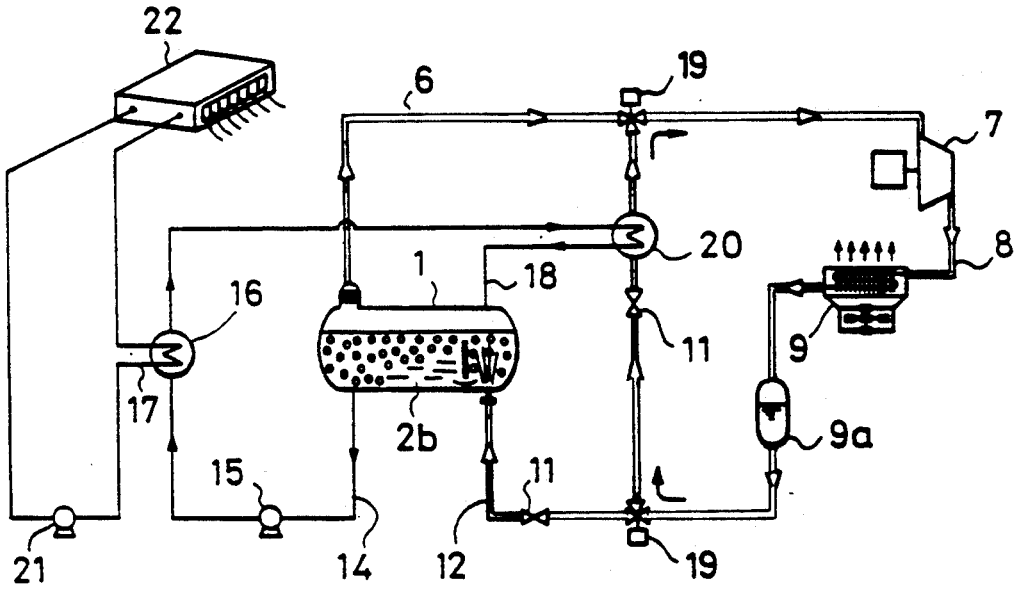
FIG. 8 is a schematic block diagram of a conventional device of refrigerant blowing type for storing heat in ice.
Figure 8B:
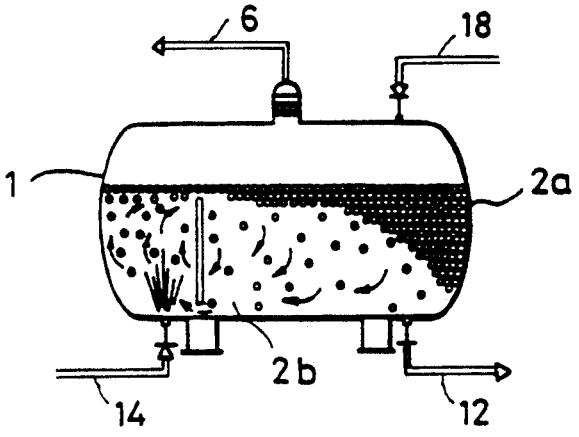
Figure 9:
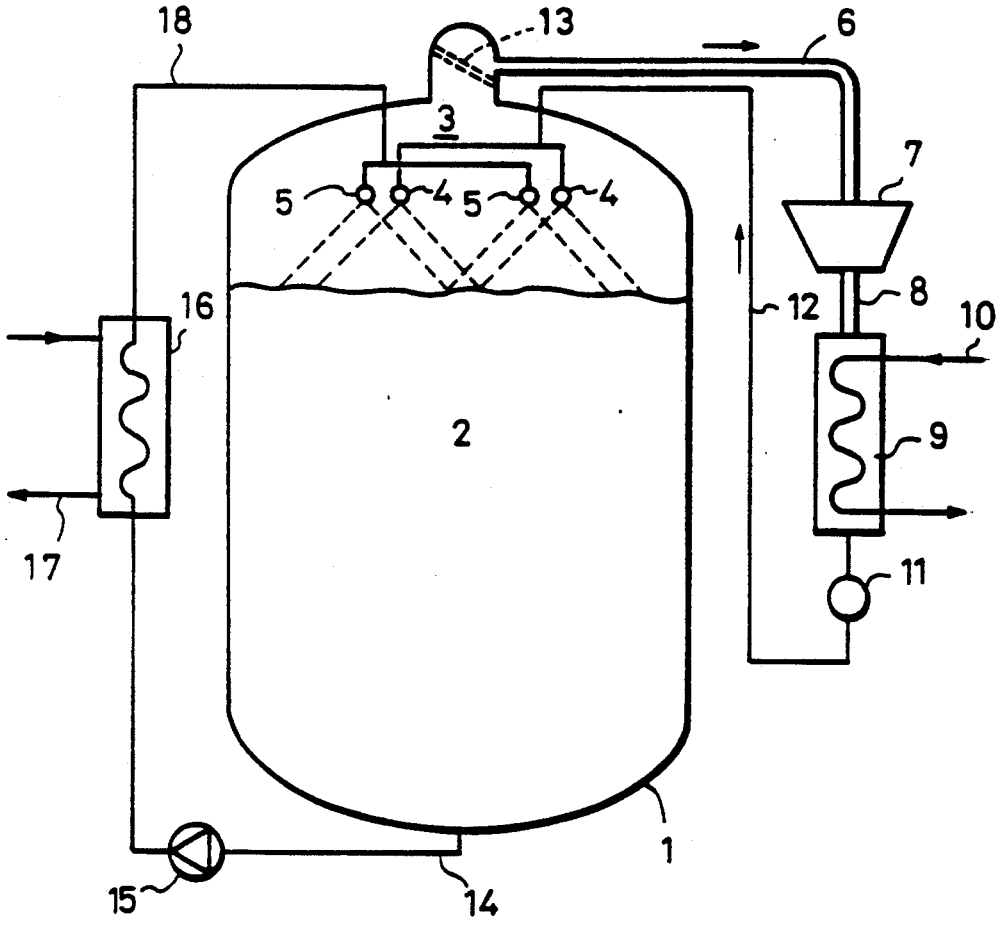
FIG. 9 is a schematic block diagram of a conventional device of individual nozzle type for storing heat in ice.
Figure 10:
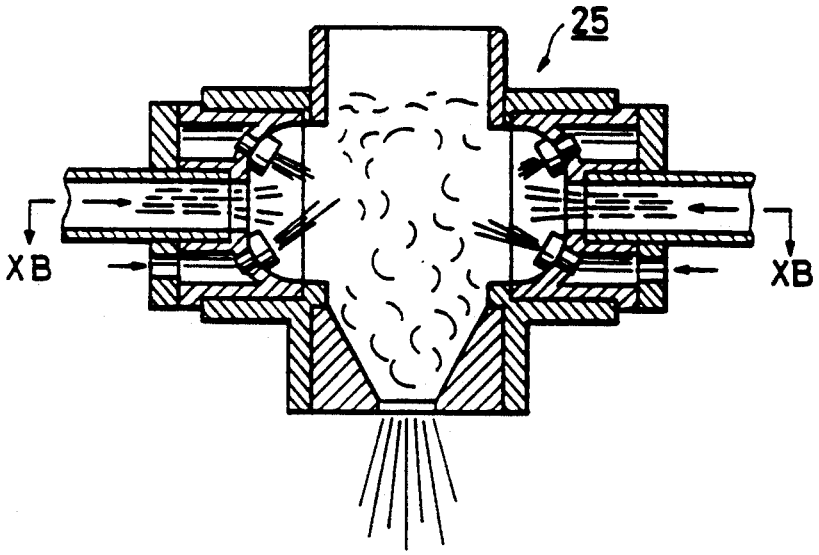
FIG. 10 is a schematic block diagram of a conventional device of chamber type for storing heat in ice.
Figure 10:
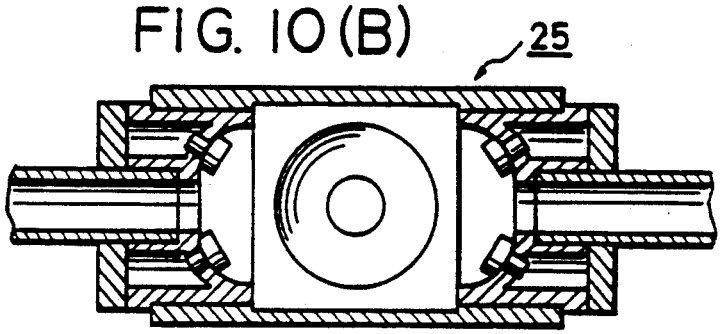
Figure 10:
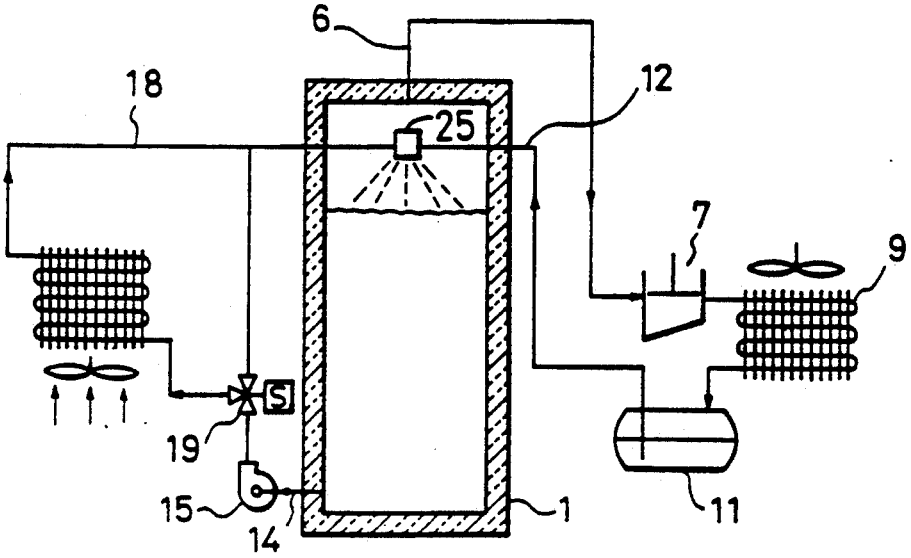

FIG. 7 shows another modification of the T-shape mixer 33, in which an ultrasonic mixer 37 is attached to the intermediate section of the horizontal portion of the mixer 33. The ultrasonic vibrator 37 thus attached pulverizes the liquid refrigerant and water into very fine particles so as to enlarge the contact area therebetween and improve the heat exchange efficiency therebetween. The mixer 33 with the ultrasonic vibrator 37 may be connected to either a single-orifice or a multi-orifice nozzle.

Figure 11:
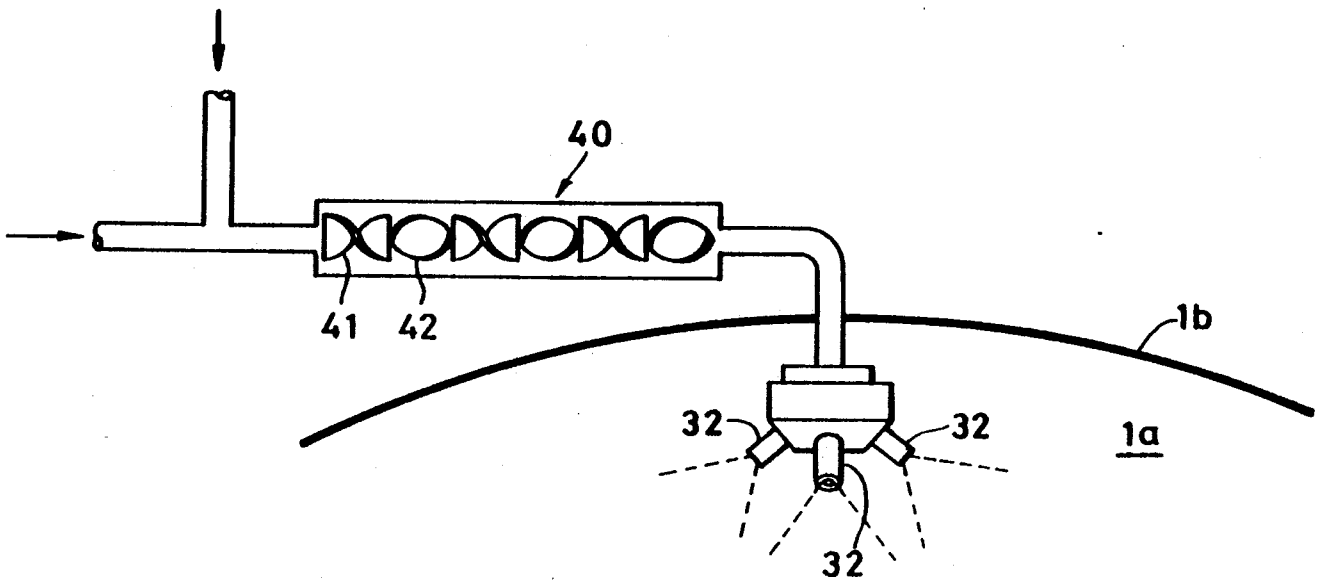
FIG. 11 is a schematic illustration of a static mixer for mixing refrigerant and water, which mixer uses a cylinder having two kinds of twisted elements fixed therein in an alternate fashion.

To mix refrigerant and water, one can use a static mixer 40 as shown in FIG. 11. The static mixer 40 has a cylinder, which cylinder has an inlet opening receiving both refrigerant and water and an outlet opening to be connected to the nozzle 32. Two kinds of twisted elements 41 and 42 are connected alternately in the cylinder. The first kind element 41 is made by twisting rightward a rectangular plate by 180°, and it may be called a rightward element. The second kind element 42 may be called a leftward element as it is twisted similarly as the first element but in opposite direction. In the static mixer 40, an angular displacement of 90° is provided between the adjacent two kinds elements; namely, between the first kind element 41 and the second kind element 42. Thus, the two kinds elements in the cylinder are connected alternately in series with a 90° displacement at the junction between the adjacent two kind elements. With such disposition of the rightward and leftward elements, it is known to those skilled in the art that fluid in the cylinder is bisected each time it passes through one element.

In the mixer 40 of FIG. 11, six elements, three right ward and three leftward, are used, and the fluid in the inlet end of the mixer 40 is divided into $64(=2^6)$ sections at its outlet. In addition to such division, the fluid entering the inlet of the mixer 40 is turned as it proceeds through the cylinder and the turning direction is reversed when it moves from one element to the next, and the fluid flow shifts between the twisted surface of the elements 41, 42 and the inside surface of the cylinder. Such combination of division, reversion of turning direction, and shifting of the flow results in thorough mixing of the fluid. Thus, when liquid mixture of refrigerant and water passes through such static mixer 40, the refrigerant and water are thoroughly mixed to ensure highly efficient heat exchange therebetween.

As described in detail in the foregoing, the method and device for heat storage in ice according to the invention mixes liquid refrigerant and water and then jets the mixture through a nozzle unit, and the following outstanding effects are achieved.

(1) The jetting of liquid refrigerant together with water enables dispersion of the resultant sherbet-like ice over a wide area, so as to assure high efficiency in heat exchange.
(2) Sherbet-like ice is produced without being affected by water in a water tank.
(3) No fluidization agent is required, and the cost therefor is saved.
(4) It is possible to avoid any drop of freezing point of the cooling water because fluidization agent is not used, and high efficiency of heat exchange is achieved.
(5) Being simple in construction, the apparatus of the invention can be made at a low cost.
(6) A number of schemes are available for mixing liquid refrigerant with water; namely, simple confluent scheme, natural circulation scheme, forced circulation scheme with a rotary impeller, fine pulverization scheme with an ultrasonic vibrator, and a combination of any of the above schemes.

What is claimed is:

1. An apparatus for storing heat by freezing water with latent heat of evaporation of a hardly-water-soluble refrigerant, comprising a heat-insulating water tank whose inside pressure is kept at P2, said pressure P2 being lower than saturation pressure P0 of a hardly-water-soluble refrigerant at water freezing point ($P2<P0$); a mixer having a first inlet for receiving the refrigerant in substantially liquid phase, a second inlet for receiving liquid water, and a mixing portion communicating with said first and second inlets, the mixer being adapted to keep inside pressure thereof at P1 that is higher than the saturation pressure P0 of the refrigerant for water freezing point ($P1>P0$) so as to prevent ice formation and mix the refrigerant and water in liquid phase; and a nozzle disposed within said water tank above a water surface thereof, said nozzle having an inlet opening connected to the mixing portion of the mixer and an outlet opening for jetting liquid from the mixer into a cone-shaped zone while causing a pressure drop from P1 to P2 between the inlet and outlet opening thereof, said zone having a vertex at the nozzle and expanding as it extends downwardly.

2. An apparatus for storing heat as set forth in claim 1, wherein said hardly-water-soluble refrigerant is normal pentane.

3. An apparatus for storing heat as set forth in claim 1, wherein said mixer is of T-shape having a horizontal straight tubular portion and a central leg portion depending from an intermediate section of the horizontal portion, said horizontal portion being adapted to receive the refrigerant in liquid phase from one end thereof while receiving water from an opposite end thereof so as to mix the refrigerant and water therein, said central leg portion communicating with said horizontal portion at the intermediate section thereof so as to extract the thus mixed liquid mixture therefrom while further mixing the refrigerant and water in the central leg portion.

4. An apparatus for storing heat as set forth in claim 1, wherein said mixer is of circulation type having a circular portion and a central leg portion depending from a central section of the circular portion, said circular portion being adapted to receive the refrigerant of liquid phase at one peripheral part thereof in a tangential direction thereat while receiving water at a diametrically opposite peripheral part thereof to said one peripheral part in a tangential direction thereat, so as to cause the refrigerant and water to circulate therein and to mix with each other while circulating, said central leg portion communicating with said circular portion at the central section thereof so as to extract the thus mixed liquid mixture therefrom.

5. An apparatus for storing heat as set forth in claim 3, wherein said mixer has a motor-driven impeller disposed in said intermediate section of the horizontal portion thereof.

6. An apparatus for storing heat as set forth in claim 3, wherein said mixer has an ultrasonic vibrator which is attached to said intermediate section of the horizontal portion thereof.

* * * * *